US006196879B1

(12) United States Patent
Hess et al.

(10) Patent No.: US 6,196,879 B1
(45) Date of Patent: Mar. 6, 2001

(54) SURFACE-MOUNTABLE MODULAR ELECTRICAL CONNECTOR ASSEMBLIES HAVING CO-PLANAR TERMINALS

(75) Inventors: John Matthew Hess; Derek Imschweiler, both of Dallastown; Jeffrey Fleming, Felton, all of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/322,449

(22) Filed: May 28, 1999

Related U.S. Application Data

(60) Provisional application No. 60/110,632, filed on Dec. 2, 1998.

(51) Int. Cl.[7] ..... H01R 24/00
(52) U.S. Cl. ..... 439/676
(58) Field of Search ..... 439/676

(56) References Cited

U.S. PATENT DOCUMENTS 4,629,266 * 12/1986 Viselli ..... 439/676
4,850,902 * 7/1989 Reed ..... 439/676
5,244,412 * 9/1993 Hatch et al. ..... 439/676
5,310,360 * 5/1994 Peterson ..... 439/676
5,766,043 * 6/1998 Talend ..... 439/676
6,012,953 * 1/2000 Francis ..... 439/676

* cited by examiner

*Primary Examiner*—Khiem Nguyen
*Assistant Examiner*—Hae Moon Hyeon
(74) *Attorney, Agent, or Firm*—Steinberg & Raskin, P.C.

(57) ABSTRACT

A connector assembly for surface mounting on a substrate including a jack and an optional shield surrounding the jack. The jack includes a housing defining a plug-receiving receptacle, contact/terminal members having a contact portion situated in the receptacle, a terminal portion extending from the housing and adapted to be surface mounted to the substrate, and an intermediate portion between the contact portion and the terminal portion. The intermediate portions of the contact/terminals members are retained or entrapped in the housing in fixed positions such that the terminal portions of the contact/terminals members extend downward and rearward from the housing in a common plane. To this end, the housing includes channels in which the intermediate portions of the contact/terminal members are placed such that the terminal portions extend from the channels at an angle to a bottom surface of the housing. Each intermediate portion has a first surface contacting a surface of the inner or outer housing part at a first location and a second surface opposite to the first surface contacting a surface of the other of the inner and outer housing parts at a second location.

25 Claims, 6 Drawing Sheets

SURFACE-MOUNTABLE MODULAR ELECTRICAL CONNECTOR ASSEMBLIES HAVING CO-PLANAR TERMINALS

CROSS-REFERENCE TO RELATED APPLICATION

This application claims priority under 35 U.S.C. §119(e) of U.S. provisional patent application Ser. No. 60/110,632 filed Dec. 2, 1998.

FIELD OF THE INVENTION

The present invention relates generally to a surface-mountable modular electrical connector assembly constructed to consistently provide co-planar terminals adapted to engage a substrate to which the connector assembly is mounted and more specifically, to modular jacks receivable of mating plugs and having a housing so constructed to consistently provide co-planar terminals.

As used herein, "surface-mountable" means that the connector assemblies are mountable onto a planar surface of a substrate, such as a printed circuit board, and include terminals adapted to engage solder portions on the planar surface of the substrate.

BACKGROUND OF THE INVENTION

Modular jack connectors or connector assemblies are well known in the telecommunications industry and have been adapted for mounting to printed circuit boards. These connector assemblies are typically used for electrical connection between two electrical communication devices. There are basically two ways to mount a connector assembly to a printed circuit board, namely surface mounting in which terminals engage soldering portions on a planar surface of the substrate and through-hole mounting in which the terminals pass through apertures in the printed circuit board. For some connector assemblies, the terminals are formed from the same electrically-conductive member as the contacts and such an electrical member is referred to herein as a contact/terminal member. In this case, the terminal portion of each contact/terminal member would engage a respective soldering portion on the planar surface of the substrate.

One recurring problem with surface-mountable connector assemblies has been to achieve co-planarity of the terminals or the terminal portions of all of the contact/terminal members in the connector assembly. The terminals or terminal portions are designed to engage solder regions of a planar substrate onto which the connector assembly is mounted. It is important that each of the terminals or terminal portions engages the respective solder region in order to ensure proper electrical connection between the same and the substrate because if the terminals or terminal portions are situated in different planes, problems may arise during the soldering to the printed circuit board resulting in improper or inadequate electrical connection.

OBJECTS OF THE INVENTION

Accordingly, it is an object of the present invention to provide new and improved surface-mountable modular connector assemblies including contact/terminal members which attain substantial co-planarity of the terminal portions of contact/terminal members to thereby reduce or eliminate problems arising from mounting of the connector assemblies to a substrate.

It is another object of the present invention to provide a new and improved construction of jacks for modular connector assemblies including contact/terminal members which can be manufactured in less time than current manufacturing processes and in fewer steps in view of the elimination of secondary forming operations for the contact/terminal members.

SUMMARY OF THE INVENTION

In order to achieve at least one of the objects mentioned above and others, one preferred embodiment of a connector assembly for surface mounting on a substrate such as a printed circuit board comprises a jack including a housing defining a plug-receiving receptacle and contact/terminal members having a contact portion situated in the receptacle, a terminal portion extending from the housing and adapted to be surface mounted to the substrate, and an intermediate portion between the contact portion and the terminal portion. The housing is a two-part housing constructed to entrap the intermediate portions between the parts of the housing such that the intermediate portions of the contact/terminals members are fixed in position and retained in the housing and terminal portions of the contact/terminals members extend rearward from the housing in a common plane.

More particularly, in one exemplifying embodiment, the housing comprises an outer housing part and an inner housing part arranged in connection with the outer housing part whereby channels are arranged in the inner housing part and constructed to angle the intermediate portions of the contact/terminal members obliquely with respect to a bottom surface of the inner housing part. The inner housing part includes two sets of channels, those arranged at an oblique angle to the bottom surface, which are situated in a rear portion of the inner housing part, and additional channels situated in a front portion of the inner housing part which is insertable into the outer housing part to thereby sandwich the contact/terminal members between the front portion of the inner housing part and a lower wall of the outer housing part. The additional channels in the front portion align with the channels in the rear portion. As such, the intermediate portions each include a first portion received in the additional channels and thus substantially parallel to and spaced from a lower surface of the housing and a second portion adjacent the terminal portion and which is received in the oblique channels extending at an angle relative to the first portion and the bottom surface of the housing. An oblique angle is thus formed between the first and second portions of the intermediate portions. The lower wall of the outer housing part includes a rear edge including grooves in alignment with the channels of the inner housing part and through which the intermediate portions of contact/terminal members extend at the beginning of their inclination.

By means of the construction of the inner and outer housing parts and channels therein, two points of entrapment between the contact/terminal members and the housing are formed, one resulting from the construction of the inner housing part and the other resulting from the construction of the outer housing part. One is the point of contact at the rear of the channel in the rear portion of the inner housing part between the upper surface of the intermediate portion and an adjacent interior surface of the channel and the other is the point of contact between a portion of the lower surface of the intermediate portion and the upper surface of the lower wall of the outer housing part adjacent the grooves thereof. The construction of the outer and inner housing parts to provide the points of entrapment upon assembly with contact/terminal members results in the terminal portion of the contact/terminal members extending from the housing with an angle relative to the bottom surface of the jack, and thus to the substrate on which the connector assembly would be mounted, which is substantially the same for all of the terminal portions. Thus, the terminal portions of the contact/terminal members would be co-planar and thereby facilitate problem-free mounting to the substrate.

BRIEF DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
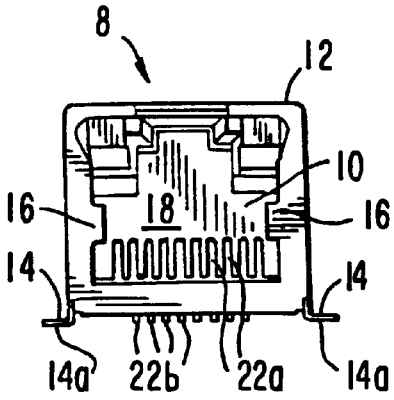
FIG. 1 is a front view of a surface-mountable connector assembly in accordance with the invention.
Figure 2:
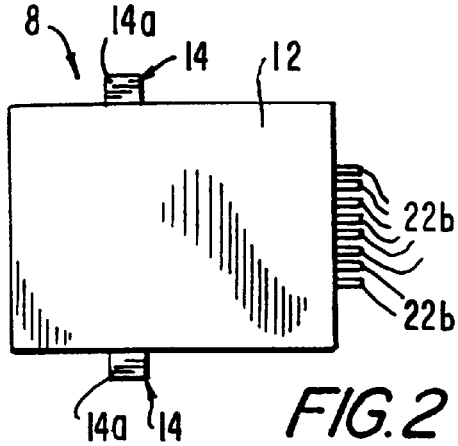
FIG. 2 is a top view of the connector assembly of FIG. 1.
Figure 3:
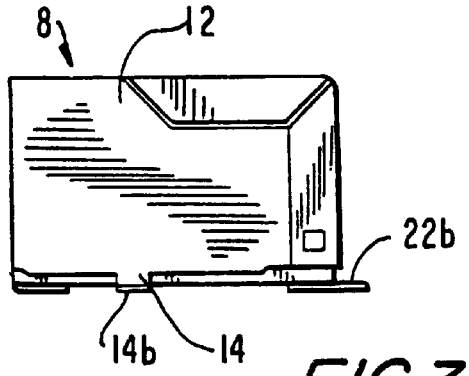
FIG. 3 is a side view of the connector assembly of FIG. 1.

Referring to the accompanying drawings wherein the same reference numerals will be used to designate identical or similar elements throughout the several views, FIGS. 1–3 show a surface-mountable connector assembly 8 in accordance with the invention including a surface-mountable jack 10 and a shield 12. To facilitate surface mounting of the connector assembly 8 to a substrate such as a printed circuit board and establish electrical grounding connection between the shield 12 and the ground of the printed circuit board, each lower side edge of the shield 12 includes an outwardly projecting L-shaped tab 14 having a flat portion 14*a* adapted to be coupled to a grounding region of the printed circuit board. The flat portions 14*a* may be arranged in-line, i.e., at the same distance rearward of the front face of the connector assembly 8 as shown, or offset from one another, i.e., at different distances rearward of the front face of the connector assembly 8. Shield 12 includes tabs 16 extending from the front face of the shield 12 inward into a plug-receiving receptacle 18 of the jack 10 and may also include other grounding tabs as known and used in the art.

Figure 4:
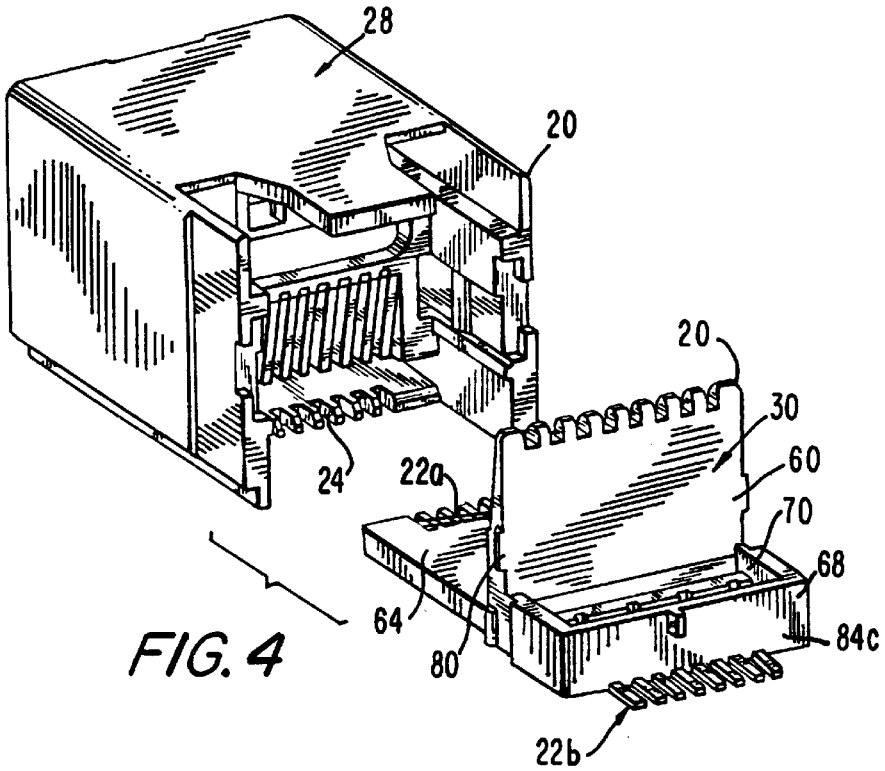
FIG. 4 is an exploded rear perspective view of the jack of the connector assembly shown in FIG. 1.
Figure 5:
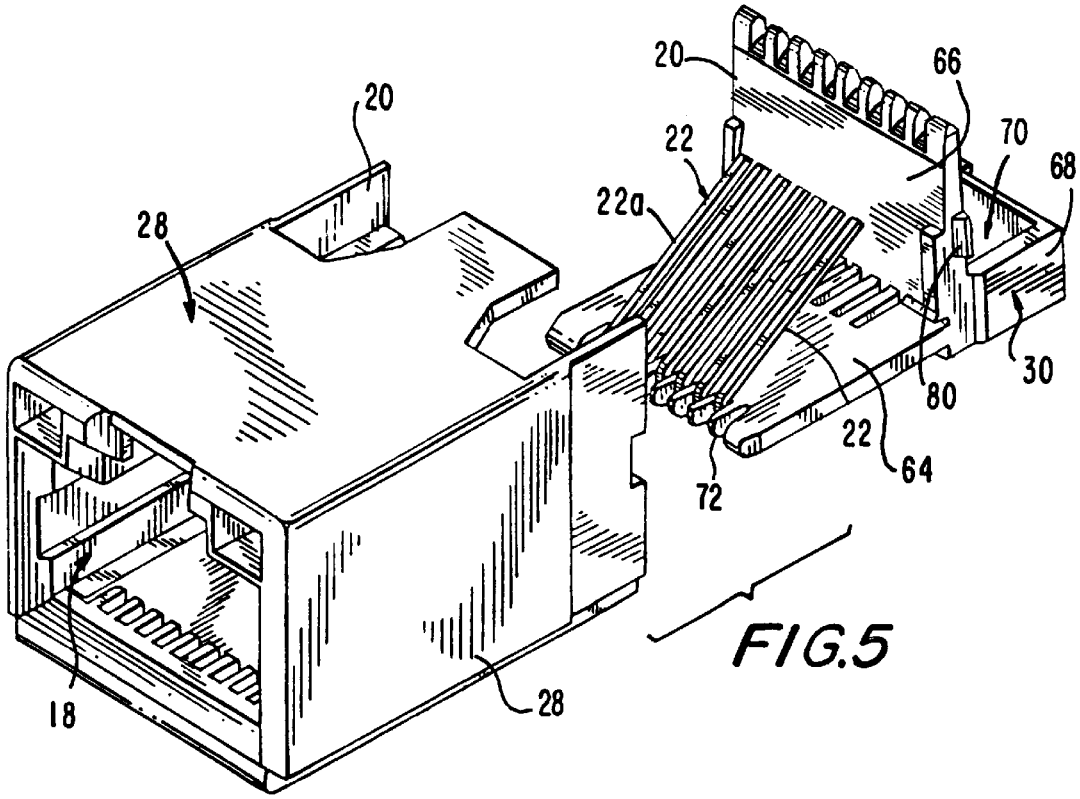
FIG. 5 is an exploded front perspective view of the jack of the connector assembly shown in FIG. 1.
Figure 6:
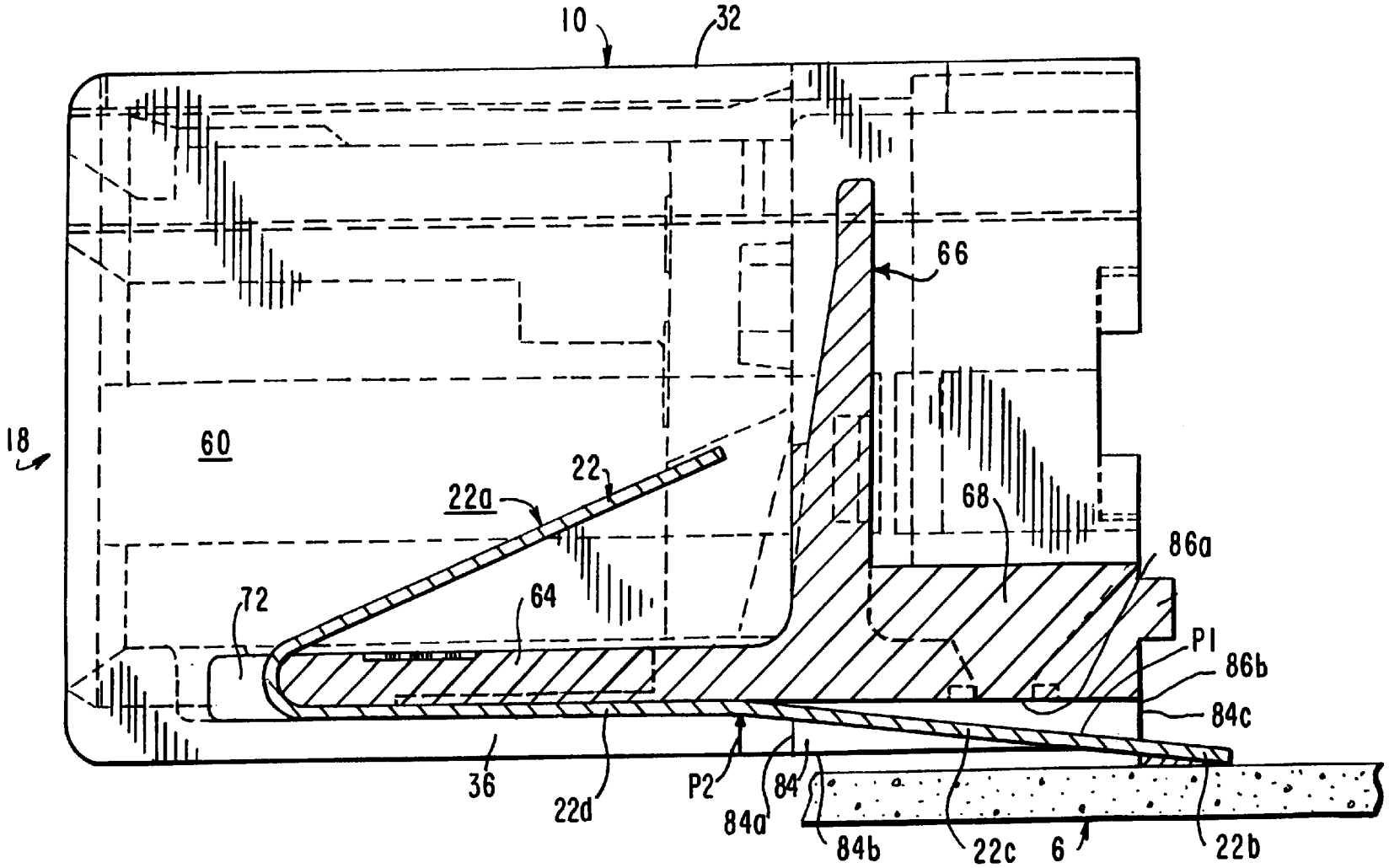
FIG. 6 is a cross-sectional view of the jack of the connector assembly shown in FIG. 1 in a mounting position to a printed circuit board.
Figure 7:
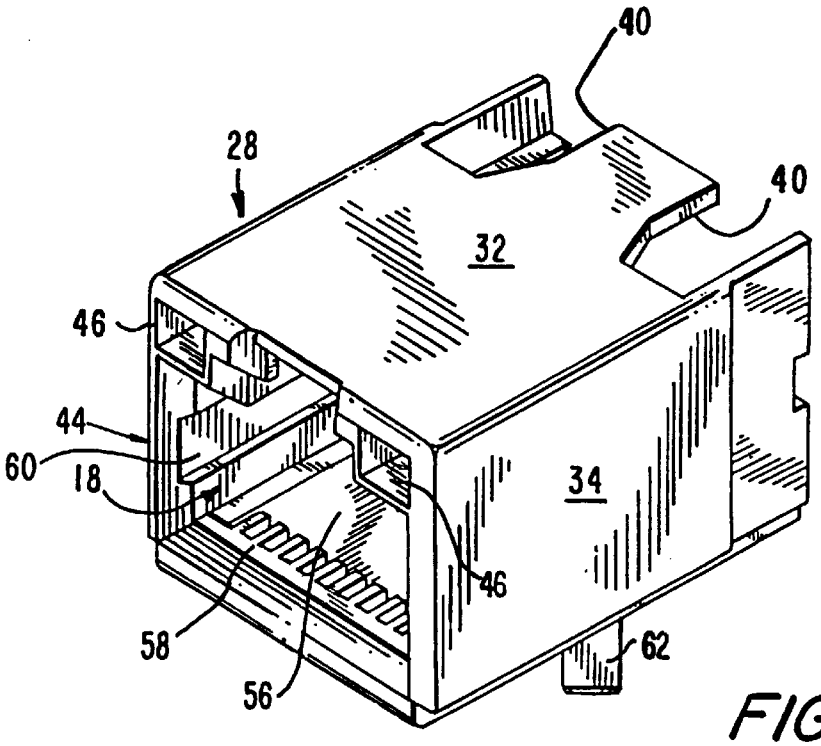
FIG. 7 is a front perspective view of an outer housing part of the jack of the connector assembly shown in FIG. 1.
Figure 8:
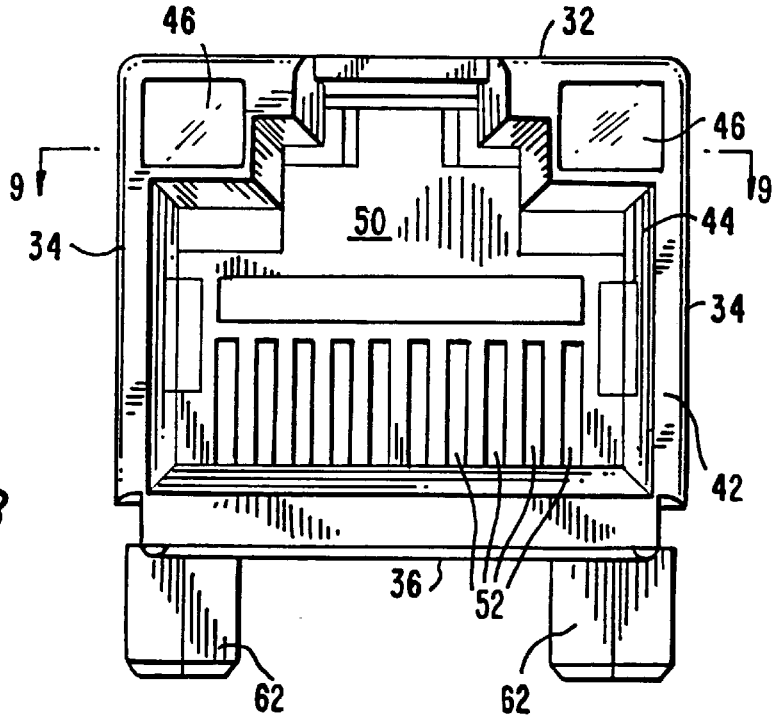
FIG. 8 is a front view of the outer housing part of FIG. 7.

As shown in greater detail in FIGS. 4–6, jack 10 includes a housing 20 defining the plug-receiving receptacle 18 and a first set of contacts 22 (also referred to herein as contact/terminal members) arranged in the housing 20. Each contact/terminal member 22 has a contact portion 22*a* situated in the receptacle 18 and a terminal portion 22*b* extending rearward from the rear face of the jack 10 and slightly below the lower face of the housing 20 (see FIG. 6). The terminal portions 22*b* are adapted to be coupled to mating pads on the planar surface of the printed circuit board 6 to which the connector assembly 8 is mounted.

Figure 9:
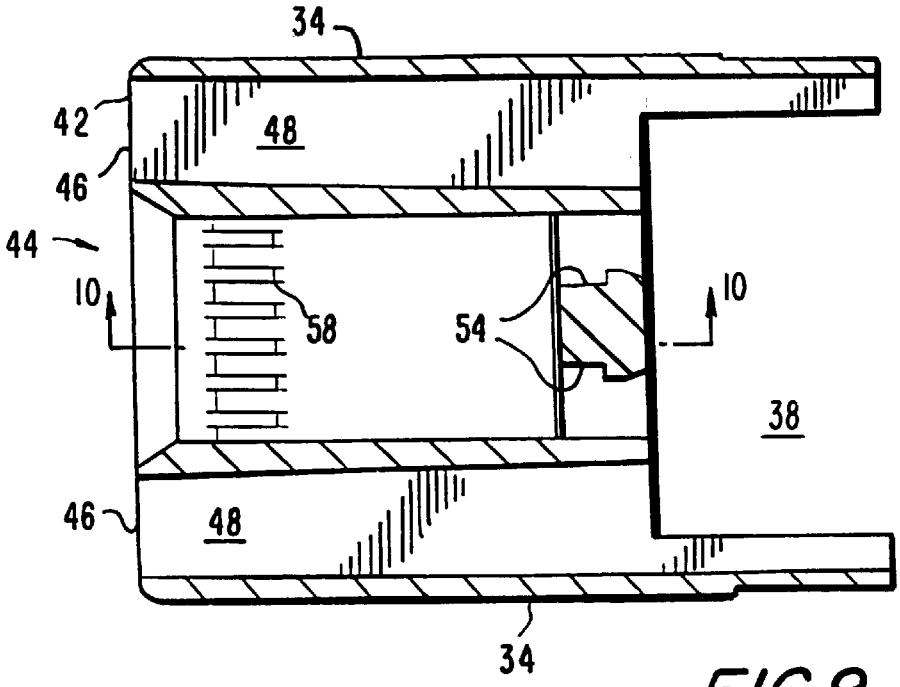
FIG. 9 is a cross-sectional view of the outer housing part of FIG. 7 taken along the line 8—8 of FIG. 8.
Figure 10:
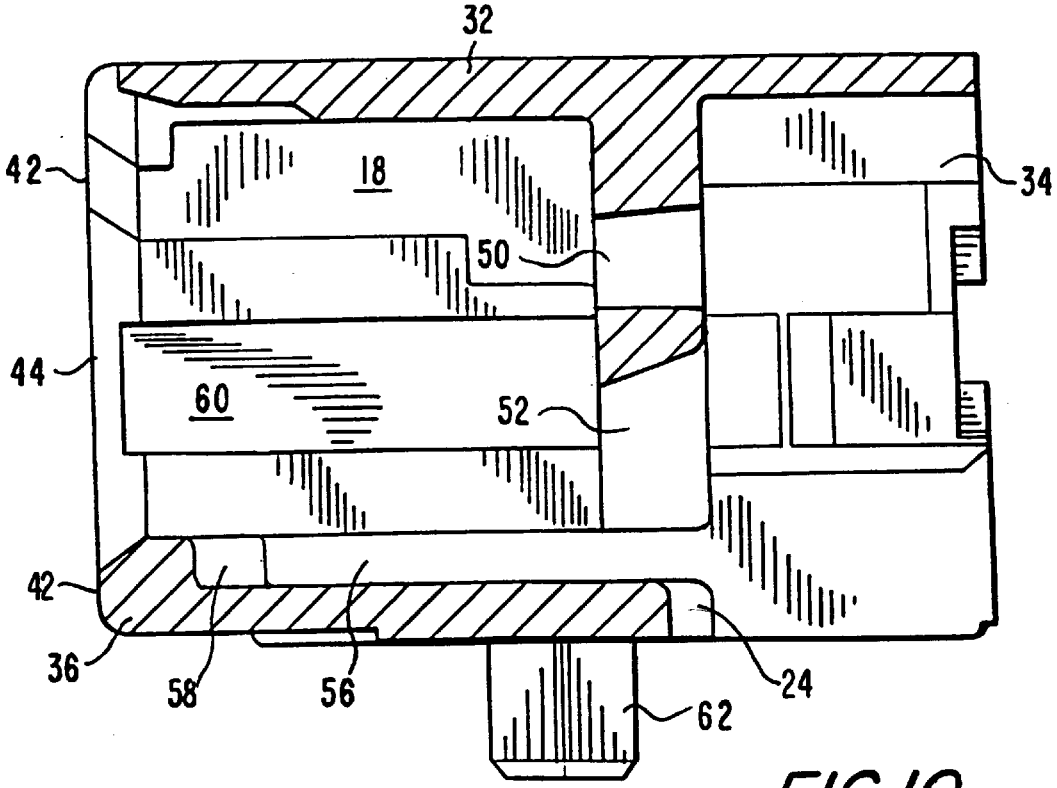
FIG. 10 is a cross-sectional view of the outer housing part of FIG. 7 taken along the line 10—10 of FIG. 9.
Figure 11:
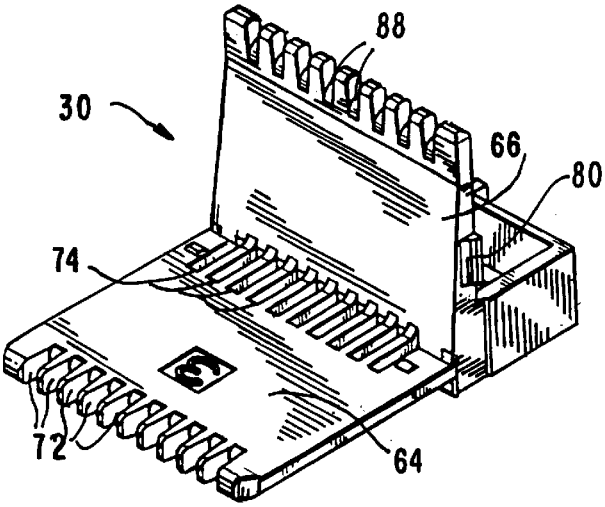
FIG. 11 is a perspective view of an inner housing part of the jack of the connector assembly shown in FIG. 1.
Figure 12:
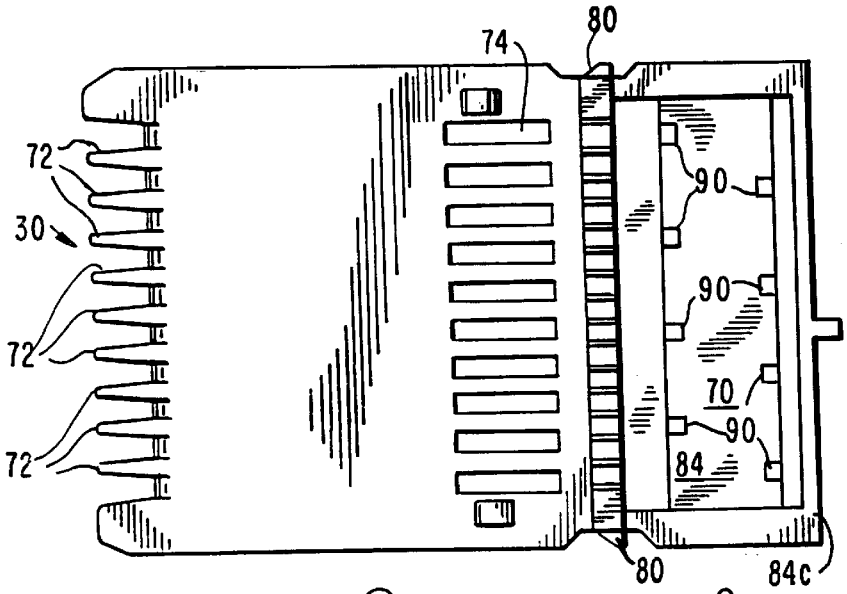
FIG. 12 is a top view of the inner housing part shown in FIG. 11.
Figure 13:
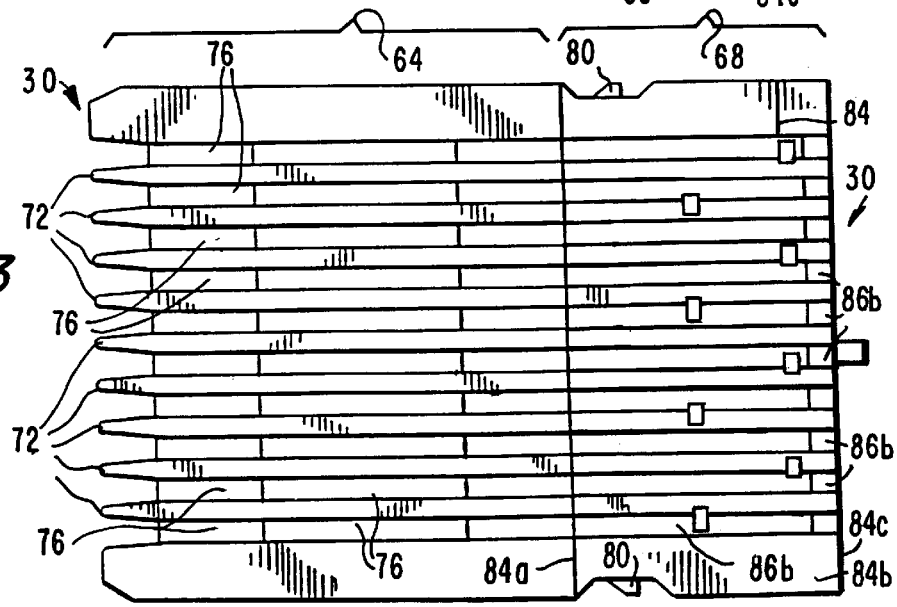
FIG. 13 is a bottom view of the inner housing part shown in FIG. 11.

Housing 20 includes an outer housing part 28, shown in detail in FIGS. 7–10, and an inner housing part 30, shown in detail in FIGS. 11–13, both made of dielectrical material. As shown in FIGS. 7–10, the outer housing part 28 includes a top wall 32, side walls 34 and a bottom wall 36. The top wall 32 and side walls 34 extend rearward beyond a rear edge of the bottom wall 36 to thereby define a cavity 38 at the rear of the outer housing part 28 (FIG. 9). The bottom wall 36 includes parallel grooves 24 at a rear edge (FIGS. 4 and 10). The front face 42 of the outer housing part 28 includes a plug aperture 44 as well as optional apertures 46 in each stepped portion. Outer housing part 28 includes a comb portion 50 defining a plurality of slots 52 for receiving ends of the contact members 22. A slot 56 is formed in the bottom wall 36 below the comb portion 50 and tongues 58 extend inward into slot 56, each tongue 58 being in alignment with a respective groove 24 (FIG. 10). The purpose of slot 56 and tongues 58 is explained below. The interior walls 60 at a front portion of the outer housing part 28 forward of the comb portion 50 define the receptacle 18. Outer housing part 28 may include mounting posts 62 extending outward and downward from the bottom wall 36 for facilitating connection of the connector assembly 8 to the printed circuit board 6, i.e., mounting posts 62 when present are adapted to be inserted into corresponding apertures in the printed circuit board. Top wall 32 includes complementary surfaces adapted to receive and retain the latch of a mating plug (see FIG. 10).

The outer housing part 28 as shown includes several optional features which are not required in order to practice the preferred embodiments of the invention. Rather, the presence of these features enables the outer housing part to be used for other applications, such as in connection with connector assemblies described in U.S. provisional patent application Ser. No. 60/104,137 filed Oct. 14, 1998. These features are recesses 40 defined at a rear of the top wall 32, a pair of optional elongate channels 48 extending from the optional apertures 46 in the front face 42 rearward to the cavity 28 and a pair of apertures 54 formed in the comb portion 50 above the slots 52.

Referring now in particular to FIGS. 11–13, inner housing part 30 has an inverted T-shape including a front, horizontal portion 64, a rear portion 68 defining a cavity or well 70 and a vertical wall 66 extending from the rear portion 68 perpendicular to the major surfaces of the front and rear portions 64,68. Front portion 64 is dimensioned to slide within the slot 56 formed in the bottom wall 36 of the outer housing part 28. Guide channels 72 are formed in the front edge of front portion 64 and a corresponding number of longitudinal guide channels 76 are formed on a lower surface of front portion 64, each in communication with a respective one of the channels 72 (FIG. 13). Channels 72 and channels 76 are dimensioned to accommodate a contact/terminal member 22. The depth of channels 76 is substantially equal to the height of the contact/terminal members 22. Ridges 80 are formed on the side surfaces of vertical wall 66 to facilitate securing of the inner housing part 30 to the outer housing part 28.

In order to attain the advantages of the invention, guide channels 86 are formed in a lower wall 84 of the rear portion 68 of inner housing part 30, each in alignment with a respective one of the guide channels 76. Guide channels 86 have a first section 86*a* having an opening in a front surface 84*a* of the lower wall 84 and a second section 86*b* having an opening at the corner of a bottom surface 84*b* and rear surface 84*c* of the lower wall 84. The first section 86*a* is recessed inward more than the second section 86*b*, i.e., has a greater depth, which results in the guide channels 86 providing an inclined or sloped path for the intermediate portions 22*c* in relation to the bottom surface 84*b* of the lower wall 84. Guide channels 86 thus have a variable depth along their length, i.e., they are deeper at the area inward of the front surface 84*a* than at the area inward of the rear surface 84*c*. As discussed in greater detail below, this construction of the guide channels 86, in combination with the construction of the bottom wall 36 of the outer housing part 28, is designed to position and fix the intermediate portions 22*c* such that the contact/terminal members 22 assume a form upon assembly of the jack 10 in which the terminal portions 22*b* of the contact/terminal members 22 are consistently in the same orientation relative to the jack 10. In this manner, the terminal portions 22*b* of all of the contact/terminal members 22 will lie in substantially the same plane at the same angle relative to the bottom surface of the jack 10 and thereby alleviate the problem of the co-planarity of terminals arising in prior art surface-mountable connector assemblies.

The inner housing part 30 as shown includes several optional features which are not required in order to practice the preferred embodiments of the invention. Rather, the presence of these features enables the inner housing part to be used for other applications, such as in connection with connector assemblies described in U.S. provisional patent application Ser. No. 60/104,137. These features are slots 74 are formed at the rear of front portion 64 adjacent the vertical wall 66, channels 88 in the top edge of the vertical wall 66, and apertures 90 at the bottom of cavity 70 extending to the bottom wall 84. Further, the rear portion 68 does not have to be constructed to define the cavity 70 at all since it is not used in the preferred embodiments.

There are several different ways to assemble the connector assembly 8. In general, the jack 10 is first assembled and then the shield 12 is laid over the jack 10. In one particular method for assembling the jack 10, the outer and inner housing parts 28,30 are molded and appropriate contact/terminal members 22 are formed or stamped. The contact/terminal members 22 are then arranged in connection with the inner housing part 30 and bent about the channels 72 to form the obliquely inclined contact portions 22*a*. The intermediate bridging portions 22*d* extend through the channels 76 formed on the lower surface of the flat portion 64 of inner housing part 28 while intermediate portions 22*c* extend through channels 86 formed in the lower wall 78 of the rear portion 68 of the inner housing part 30 (see FIGS. 4 and 5). As shown in FIG. 4, the terminal portions 22*b* of the contact/terminal members 22 extend obliquely downwardly for attachment to a printed circuit board in view of the lesser depth of the rear portion 86*a* of the channels 86.

Thereafter, the inner housing part 30 is inserted into the outer housing part 28 to form jack 10 by sliding the flat portion 64 of the inner housing part 30 into the slot 56 in the outer housing part 28 until the ridges 80 snap into mating structures of the outer housing part 28. Insertion of the inner housing part 30 into the outer housing part 28 is guided by the presence of the tongues 58 of the outer housing part 28 which enter into the channels 72 (see FIG. 6). The contact/terminal members 22 are thus retained between the channels 72 of the inner housing part 30 and the tongues 58 of the outer housing part 28. Upon insertion of the inner housing part 30 having the contact/terminal members 22 arranged in connection therewith into the outer housing part 28, the intermediate portion 22*d* of each contact/terminal member 22 will lie against the upper surface of the bottom wall 36 and a portion thereof will pass into a respective groove 24. As shown in FIG. 6, the intermediate portion 22*c* and terminal portion 22*b* define a substantially straight portion of the contact/terminal member 22.

An important feature of the assembled jack 10 is the manner in which the contact/terminal members 22 are "entrapped" or secured to the jack housing 20. Specifically, there are two points of entrapment between the contact/terminal members 22 and the housing 20, one resulting primarily from the construction of the inner housing part 30 and the other resulting primarily from the construction of the outer housing part 28. As shown in FIG. 6, the first point of entrapment P1 is the point of contact in the second section 86*b* of the channel 86 between the upper surface of the intermediate portion 22*c* and an adjacent interior surface of the channel 86. The second point of entrapment P2 is the point of contact between a portion of the lower surface of the intermediate portion 22*d* and the upper surface 84*a* of the bottom wall 34 adjacent the grooves 24. The construction of the outer and inner housing parts 28,30 to provide the points of entrapment P1,P2 upon assembly with contact/terminal members 22 results in the terminal portion 22*b* of the contact/terminal members 22 extending from the housing 20 with an angle relative to the bottom surface of the jack 10, and thus to the substrate on which the connector assembly 8 would be mounted, which is substantially the same for all of the terminal portions 22*b*. Thus, the terminal portions 22*b* of the contact/terminal members 22 would be co-planar and thereby facilitate problem-free mounting to the printed circuit board 6 (FIG. 6).

The resulting co-planar arrangement of the terminal portions 22*b* of the contact/terminal members 22 provides significant advantages. For example, since connector assemblies 8 are constructed with a number of contact/terminal members 22, each contact/terminal member may have mechanical properties that differ from those of the other contact/terminal members. This difference in mechanical properties causes irregularities when the contact/terminal members are formed in a conventional stamping operation and a jack is assembled with the same. Entrapping the contact/terminal members upon assembly of the jack eliminates the problem caused by different mechanical properties of the contact/terminal members.

Moreover, since the angle of the terminal portions 22*b* is the same, a solder web 90 may be formed along the terminal portion 22*b* of each contact/terminal member 22 and will be properly aligned for a soldering operation in which the contact/terminal members 22 are electrically coupled to the printed circuit board 6 (see FIG. 6).

Another advantage of the entrapment design is that the connector assembly time is shortened because secondary forming operations in which the contact members are manipulated and positioned are eliminated.

Yet another advantage is that the contact/terminal members 22 may be pre-loaded into the inner housing part 30 and thereby prevent shorting of the contact/terminal members 22 to one another. As such, assembly of the jack 10 would entail only insertion of the inner housing part 30 into the outer housing part 28.

As noted above, to form the connector assembly 8, shield 12 is placed over the jack 10 and the connector assembly is then ready to be surface mounted to the printed circuit board 6 (FIG. 6). Shield 12 may be secured to jack 10 by any conventional means, although in the illustrated embodiment the staking post 92 is arranged on the rear wall 94 of the inner housing part 30 for enabling a hot or cold staking assembly process (FIGS. 12 and 13). Shield 12 is an optional feature of the connector assembly 8 and the connector assembly 8 may simply comprise the jack 10.

In the illustrated embodiment, the jack 10 is of the RJ-45 type in that it includes eight contact/terminal members 22. However, the housing 20 is designed to accommodate up to ten contact members 22.

Although the jack 10 shown in FIGS. 1–6 includes eight contact members, the outer housing part 28 and inner housing part 30 may be designed to accommodate any number of contact/terminal members without deviating from the spirit and scope of the invention. Also, the outer housing part 28 and inner housing part 30 may be constructed differently, e.g., in shape, yet still provide the advantages of this embodiment of the invention if channels or bores are formed in one housing part to receive the contact members and, when this housing part is assembled together with the other housing part, the two housing parts cooperate to entrap the contact members in a particular position. Also, although the channels 86 are shown formed in the inner housing part 30, it is within the scope and spirit of the invention to provide channels in the outer housing part 28 instead.

Furthermore, although not shown, an external LED holder and light pipe element described in U.S. provisional patent application Ser. No. 60/110,632 may be arranged in the jack 10 since the outer housing part 28 is formed to receive such a light pipe element and the shield 12 may be formed to mate with the LED holder. However, it is envisioned that the jack may be constructed without the LED holder and light pipe element, in which case, inter alia, the top surface of the outer housing part 28 does not require cavities 40, the front face of the outer housing part 28 would not require apertures 46 and channels 48 would not be formed in the outer housing part 28.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims. For example, the inner housing part may be constructed to include only the minimum of structure to enable guidance of the contact/terminal members, e.g., without the vertical wall 66.

We claim:

1. A connector assembly for surface mounting on a substrate, comprising a jack comprising a housing defining a plug-receiving receptacle, and contact/terminal members having a contact portion situated in said receptacle, a terminal portion extending from said housing and adapted to be surface mounted to the substrate, and an intermediate portion between said contact portion and said terminal portion, said contact/terminal members having a substantially straight portion including said terminal portion, said straight portion having an upper surface contacting said housing at a first location adjacent the terminal portion and a lower surface contacting said housing at a second location spaced from said first location such that said contact/terminal members are entrapped by said housing by virtue of contact between said contact/terminal members and said housing at said first and second locations and said terminal portions of said contact/terminal members extend rearward from said housing in a common plane.

2. The connector assembly of claim 1, wherein said housing comprises channels in which said intermediate portions of said contact/terminal members are received.

3. The connector assembly of claim 2, wherein said channels are arranged such that said terminal portions extend downward from said housing and thus at an angle to a bottom surface of said housing.

4. The connector assembly of claim 1, wherein said intermediate portions of said contact/terminal members each include a first intermediate portion substantially parallel to and spaced from a lower surface of said housing and a second intermediate portion extending at an angle relative to said first intermediate portion and a bottom surface of said housing, said terminal portion being situated adjacent said second intermediate portion.

5. The connector assembly of claim 1, wherein said housing comprises an outer housing part and an inner housing part arranged in connection with said outer housing part.

6. The connector assembly of claim 5, wherein said inner and outer housing parts cooperate to entrap said intermediate portions in said housing at at least two locations and thereby fix all of said contact/terminal members in the same position.

7. The connector assembly of claim 5, wherein said inner housing part comprises channels in which said intermediate portions of said contact/terminal members are received.

8. The connector assembly of claim 7, wherein said inner housing part has a bottom surface, said channels being arranged at an oblique angle to said bottom surface.

9. The connector assembly of claim 7, wherein said inner housing part includes a bottom surface, a rear surface and a forward facing surface substantially parallel to said rear surface, said channels having a first opening in said forward facing surface and a second opening formed at a corner between said bottom surface and said rear surface such that said second opening has a first portion in said bottom surface and a second portion in said rear surface.

10. The connector assembly of claim 9, wherein said channels have a first section adjacent said forward facing surface having a first depth and a second section adjacent said rear surface having a second depth less than said first depth.

11. The connector assembly of claim 5, wherein said outer housing part includes a slot, said inner housing part including a front portion insertable into a slot in said outer housing part, first channels arranged on a lower surface of said front portion, a rear portion situated rearward of said front portion, second channels arranged in said rear portion in alignment with said first channels, said intermediate portion of said contact/terminal members being arranged in said first and second channels.

12. The connector assembly of claim 11, wherein said outer housing part includes a bottom wall having said slot for receiving said front portion of said inner housing part.

13. The connector assembly of claim 11, wherein said outer housing part includes a bottom wall having a rear edge including third channels in alignment with said first and second channels of said inner housing part, said intermediate portions of contact/terminal members extending through said third channels.

14. The connector assembly of claim 5, wherein said intermediate portion has a first surface contacting a surface of one of said inner and outer housing parts at a first location and a second surface opposite to said first surface contacting a surface of the other of said inner and outer housing parts at a second location.

15. The connector assembly of claim 5, wherein said inner housing part comprises guide channels formed at a front edge of said inner housing part and said outer housing part comprises tongues formed in alignment with said guide channels such that said contact/terminal members are retained between said guide channels and said tongues.

16. The connector assembly of claim 5, wherein said outer housing part includes a top wall, side walls and a bottom wall, said top wall and side walls extending beyond a rear edge of said bottom wall to thereby define a cavity at a rear of said outer housing part, said inner housing part being situated at least partially in said cavity.

17. The connector assembly of claim 5, wherein said outer housing part includes a front face having a plug aperture, said outer housing part and said inner housing part cooperating to define said receptacle in alignment with said plug aperture.

18. The connector assembly of claim 1, further comprising a shield arranged around at least a portion of said jack.

19. The connector assembly of claim 1, wherein said intermediate portion of each of said contact/terminal members extends entirely between said terminal portion and said contact portion, said intermediate portions of said contact/terminal members being fixed in position by said housing such that movement of said intermediate portions is prevented.

20. A connector assembly for surface mounting on a substrate, comprising a jack comprising a housing defining a plug-receiving receptacle, said housing comprising an outer housing part and an inner housing part arranged in connection with said outer housing part, and contact/terminal members having a contact portion situated in said receptacle, a terminal portion extending from said housing and adapted to be surface mounted to the substrate, and an intermediate portion between said contact portion and said terminal portion, said intermediate portions of said contact/terminals members being entrapped in said housing and fixed in position such that said terminal portions of said contact/terminals members extend rearward from said housing in a common plane, said inner housing part comprising channels in which said intermediate portions of said contact/terminal members are received, said inner housing part including a bottom surface, a rear surface and a forward facing surface substantially parallel to said rear surface, said channels having a first opening in said forward facing surface and a second opening formed at a corner between said bottom surface and said rear surface such that said second opening has a first portion in said bottom surface and a second portion in said rear surface.

21. The connector assembly of claim 20, wherein said channels have a first section adjacent said forward facing surface having a first depth and a second section adjacent said rear surface having a second depth less than said first depth.

22. A connector assembly for surface mounting on a substrate, comprising a jack comprising a housing defining a plug-receiving receptacle, said housing comprising an outer housing part and an inner housing part arranged in connection with said outer housing part, and contact/terminal members having a contact portion situated in said receptacle, a terminal portion extending from said housing and adapted to be surface mounted to the substrate, and an intermediate portion between said contact portion and said terminal portion, said intermediate portions of said contact/terminals members being entrapped in said housing and fixed in position such that said terminal portions of said contact/terminals members extend rearward from said housing in a common plane, said outer housing part including a slot and said inner housing part including a front portion insertable into said slot in said outer housing part, said inner housing part further including first channels arranged on a lower surface of said front portion, a rear portion situated rearward of said front portion, second channels arranged in said rear portion in alignment with said first channels, said intermediate portion of said contact/terminal members being arranged in said first and second channels.

23. The connector assembly of claim 22, wherein said outer housing part includes a bottom wall having a rear edge including third channels in alignment with said first and second channels of said inner housing part, said intermediate portions of contact/terminal members extending through said third channels.

24. A connector assembly for surface mounting on a substrate, comprising a jack comprising a housing defining a plug-receiving receptacle, said housing comprising an outer housing part and an inner housing part arranged in connection with said outer housing part, and contact/terminal members having a contact portion situated in said receptacle, a terminal portion extending from said housing and adapted to be surface mounted to the substrate, and an intermediate portion between said contact portion and said terminal portion, said intermediate portions of said contact/terminals members being entrapped in said housing and fixed in position such that said terminal portions of said contact/terminals members extend rearward from said housing in a common plane, said intermediate portions having a first surface contacting a surface of one of said inner and outer housing parts at a first location and a second surface opposite to said first surface contacting a surface of the other of said inner and outer housing parts at a second location.

25. A connector assembly for surface mounting on a substrate, comprising a jack comprising a housing defining a plug-receiving receptacle, said housing comprising an outer housing part and an inner housing part arranged in connection with said outer housing part, and contact/terminal members having a contact portion situated in said receptacle, a terminal portion extending from said housing and adapted to be surface mounted to the substrate, and an intermediate portion between said contact portion and said terminal portion, said intermediate portions of said contact/terminals members being entrapped in said housing and fixed in position such that said terminal portions of said contact/terminals members extend rearward from said housing in a common plane, said inner housing part comprising guide channels formed at a front edge, said outer housing part comprises tongues formed in alignment with said guide channels such that said contact/terminal members are retained between said guide channels and said tongues.

* * * * *